US008113129B1

(12) United States Patent
Hurley et al.

(10) Patent No.: US 8,113,129 B1
(45) Date of Patent: Feb. 14, 2012

(54) PALLET SYSTEM

(75) Inventors: Rupert Andrew Hurley, Clemson, SC (US); Judson T. Valentine, Central, SC (US); Matthew J. Whitlock, Mt. Pleasant, SC (US); Jason Szymanski, Seneca, SC (US); Kyle D. Dunno, Anderson, SC (US)

(73) Assignee: Clemson University Research Foundation, Clemson, SC (US)

( * ) Notice: Subject to any disclaimer, the term of this patent is extended or adjusted under 35 U.S.C. 154(b) by 238 days.

(21) Appl. No.: 12/540,008

(22) Filed: Aug. 12, 2009

Related U.S. Application Data

(60) Provisional application No. 61/088,434, filed on Aug. 13, 2008.

(51) Int. Cl.
*B65D 19/00* (2006.01)

(52) U.S. Cl. ..... 108/51.3; 108/56.3; 108/57.19

(58) Field of Classification Search ..... 108/51.3, 108/56.1, 57.33, 57.17–57.19, 57.2, 57.21–57.22, 108/56.3
See application file for complete search history.

(56) References Cited

U.S. PATENT DOCUMENTS

| | | | | |
|---|---|---|---|---|
| 4,228,744 | A | 10/1980 | Moore | |
| 4,244,472 | A | 1/1981 | Brown | |
| 4,867,074 | A | 9/1989 | Quasnick | |
| 4,875,419 | A | 10/1989 | Helton et al. | |
| 4,936,229 | A | 6/1990 | Parnell | |
| 4,979,446 | A | 12/1990 | Winebarger | |
| 5,176,090 | A | 1/1993 | Roberts et al. | |
| 5,184,558 | A * | 2/1993 | Wozniacki | 108/51.3 |
| 5,285,731 | A | 2/1994 | McIntyre | |
| 5,452,667 | A | 9/1995 | Lim | |
| 5,487,345 | A * | 1/1996 | Winebarger et al. | 108/51.3 |
| 5,568,774 | A * | 10/1996 | Hutchison | 108/51.3 |
| 6,155,181 | A * | 12/2000 | Chilcutt | 108/51.3 |
| 6,973,882 | B2 | 12/2005 | Baechle et al. | |
| 7,000,549 | B2 | 2/2006 | Nelson | |
| 7,475,639 | B2 * | 1/2009 | Chen | 108/51.3 |
| 7,905,183 | B2 * | 3/2011 | Gibson et al. | 108/51.3 |
| 2006/0102055 | A1 * | 5/2006 | Wu et al. | 108/51.3 |
| 2007/0256614 | A1 * | 11/2007 | Chen | 108/153.1 |
| 2007/0283857 | A1 | 12/2007 | Dong | |
| 2008/0047473 | A1 | 2/2008 | Ferguson | |
| 2008/0295747 | A1 * | 12/2008 | Vinderola | 108/51.3 |

* cited by examiner

*Primary Examiner* — Hanh V Tran
(74) *Attorney, Agent, or Firm* — Dority & Manning, P.A.

(57) ABSTRACT

Pallet systems are described that can be formed of corrugated paperboard without the necessity of any attachment materials such adhesives, staples, or the like. Individual stringers of a pallet matrix are interwoven together, with stringer notches interlocking with notches of crossing stringers from both above and below any one stringer. Systems can be easily and quickly assembled and, should the need arise, can be quickly repaired, for instance by replacement of one or more individual runners. Systems can also exhibit extremely high strength, and can withstand greater than about 20,000 pounds of static compression at less than about ⅜ inch deflection.

20 Claims, 10 Drawing Sheets

PALLET SYSTEM

CROSS REFERENCE TO RELATED APPLICATION

The present application claims filing benefit of U.S. Provisional Application Ser. No. 61/088,434 having a filing date of Aug. 13, 2009, entitled "PALLET SYSTEM," which is incorporated herein in its entirety.

BACKGROUND

Pallets, also referred to as skids, carriers, and base pads, have been utilized to store and transport goods for many years. Traditionally, pallets were formed of steel or lumber cut from any of a variety of trees. More recently, less expensive materials have been introduced for formation of pallets including plastics, wood-based composites (e.g., plywood, particle board, etc.), and corrugated paperboard.

There are problems with existing systems. For instance, pallets constructed of steel, wood and wood by-products are ecologically wasteful, heavy, and expensive. Plastic pallet systems are also ecologically wasteful, in that they utilize non-renewable resources. In addition, plastic pallets are often quite heavy and present disposal problems, as they are generally not formed of recyclable materials.

Existing corrugated paperboard pallet systems provide some beneficial characteristics, in that they are generally much lighter than systems formed of other materials, and they are less expensive than other systems, but problems still exist. For instance, most corrugated paperboard pallet systems require some form of attachment material, usually adhesives, to be constructed. Attachment materials can have detrimental effects on recyclability of the pallet as well as increase formation costs. In addition, corrugated paperboard pallets tend to have much lower limits with regard to compressive force able to be withstood. For example, corrugated paperboard pallets can typically withstand compressive forces of approximately 3000 pounds of static compression.

What are needed in the art are improved pallet systems, and in particular, those formed of corrugated paperboard. More specifically, what are needed are pallet systems that can be formed entirely of recyclable materials, can be completely assembled quickly and easily without the need of additional materials for attaching pallet pieces together, can be formed to any desired size, are easily repairable, and can withstand high loads.

SUMMARY

According to one embodiment, disclosed is a pallet system comprising a plurality of support stringers. More specifically, the plurality of support stringers can include a first support stringer interlocked with at least a second support stringer and a third support stringer along the length of the first support stringer. The first support stringer can interlock with the second support stringer from a first side and can interlock with the third support stringer from a second opposing side such that the first, second, and third support stringers are interwoven with one another.

According to another embodiment, disclosed is a method of forming a pallet system. For instance, a method can include interlocking a first support stringer with a second support stringer and interlocking the first support stringer with a third support stringer. More specifically, the first support stringer can interlock with the second and third support stringers from opposite sides such that the first, second, and third support stringers are interwoven with one another.

Beneficially, disclosed pallet systems can be formed in one embodiment with no attachment devices or materials necessary. For instance, disclosed devices can be formed exclusively from corrugated cardboard, in one preferred embodiment, and need not utilize any sort of adhesive, staples, etc. to hold the pallet together. Other benefits and advantages of disclosed systems and methods are further described herein.

BRIEF DESCRIPTION OF THE FIGURES

A full and enabling description of the presently disclosed subject matter, including the best mode thereof, to one of ordinary skill in the art, is set forth more particularly in the remainder of the specification, including reference to the accompanying Figures, in which.

Figure 1:
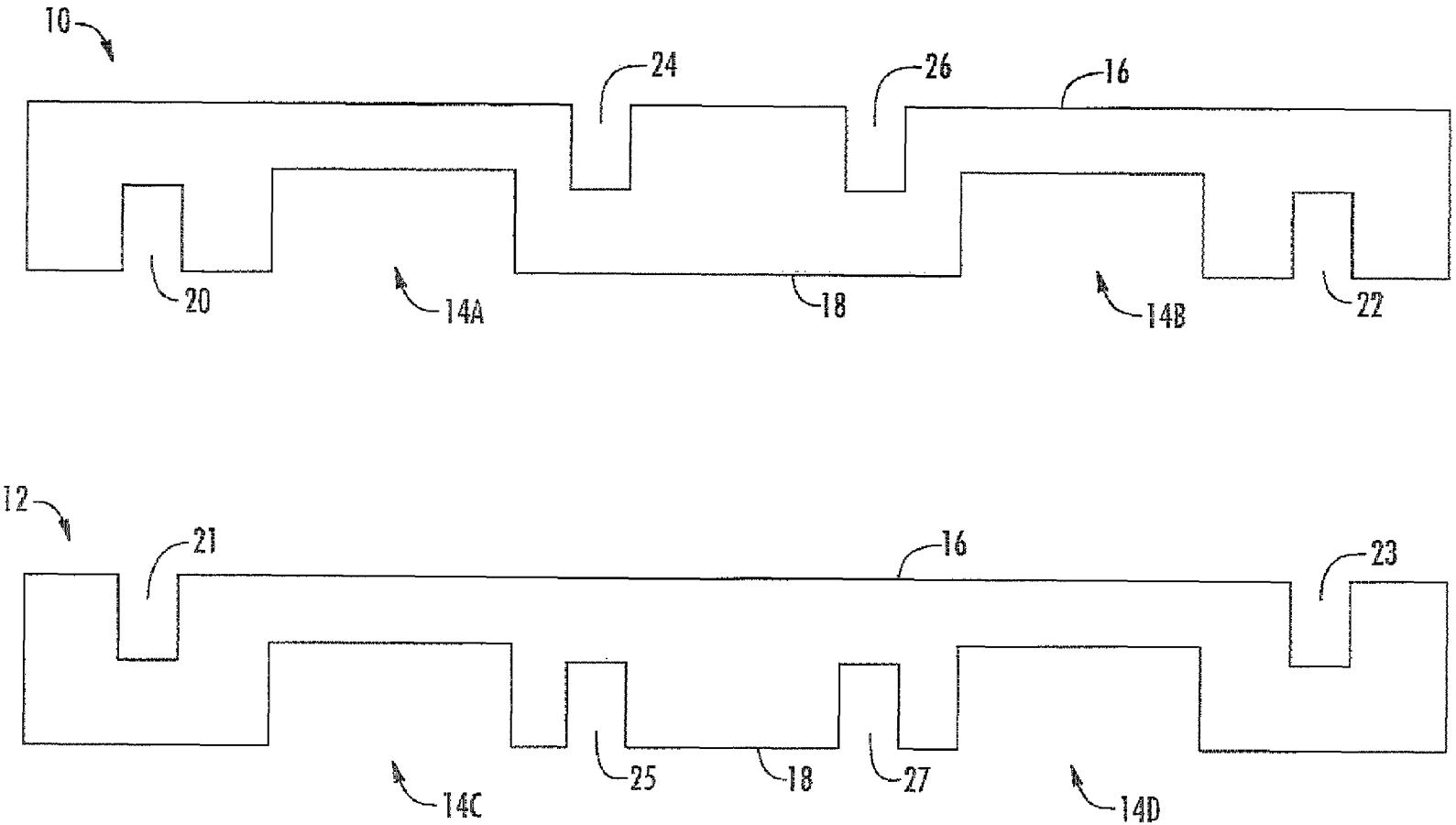
FIG. 1 illustrates one embodiment of support runners as may be utilized in forming disclosed pallets.

Repeat use of reference characters in the present specification and drawings is intended to represent the same or analogous features or elements of the present invention.

DETAILED DESCRIPTION OF REPRESENTATIVE EMBODIMENTS

Reference will now be made in detail to various embodiments of the disclosed subject matter, one or more examples of which are set forth below. Each embodiment is provided by way of explanation of the subject matter, not limitation thereof. In fact, it will be apparent to those skilled in the art that various modifications and variations may be made to the disclosed subject matter without departing from the scope or spirit of the disclosure. For instance, features illustrated or described as part of one embodiment, may be used with another embodiment to yield a still further embodiment.

In general, disclosed subject matter is directed to pallet systems. In one preferred embodiment, disclosed systems can be formed entirely of recyclable materials. Beneficially, disclosed systems can be completely assembled without the need of any additional attachment materials. More specifically, all of the individual pieces of disclosed systems can interlock with one another with no adhesives, straps, staples, or any other attachment device necessary to securely hold a pallet together. As such, disclosed systems can be easily and quickly assembled and, should the need arise, can be quickly repaired, for instance by replacement of one or more individual runners. Disclosed systems can also exhibit extremely high strength, and can withstand, in one embodiment, greater than about 20,000 pounds of static compression at less than about ⅜ inch deflection.

In general, disclosed pallet systems can be formed entirely of corrugated paperboard. For instance any standard flute designation is encompassed by the present disclosure. Table 1, below presents standard flute designations as are generally known in the art.

TABLE 1

| Flute Designation | Flutes per lineal foot | Flute thickness (in) | Flutes per lineal meter | Flute thickness (mm) |
|---|---|---|---|---|
| A flute | 33 +/− 3 | 3/16 | 108 +/− 10 | 4.8 |
| B flute | 47 +/− 3 | 1/8 | 154 +/− 10 | 3.2 |
| C flute | 39 +/− 3 | 5/32 | 128 +/− 10 | 4.0 |
| E flute | 90 +/− 4 | 1/16 | 295 +/− 13 | 1.6 |
| F flute | 128 +/− 4 | 1/32 | 420 +/− 13 | 0.8 |

Disclosed systems are in no way limited to the materials of Table 1, however. Disclosed systems can be constructed from any corrugated paperboard as is known in the art or as can be formed by one of skill in the art. As such, disclosed systems can be formed so as to meet any necessary specification. For instance, disclosed systems can be formed of various different materials depending upon the expected use of a formed pallet system. By way of example, maritime transport requires materials exhibiting minimum wet strength values, and disclosed pallet systems can be formed to include such materials.

In one preferred embodiment, disclosed pallet systems can be formed entirely of a single type of corrugated paperboard. For example, all support runners, all reinforcement runners, and the deck cap can all be formed of a single material type. This is not a requirement, however, and in other embodiments, a mixture of materials can be utilized. Moreover, while the majority of this disclosure is directed to the utilization of only corrugated paperboard in formation of disclosed pallets, it should be understood that the present disclosure is in no way limited to only corrugated paperboard as a formation material. For instance, in one embodiment some or all individual pieces of a pallet can be formed of other materials including, but not limited to, wood, wood-based composite materials, plastics, metals, and so forth.

Referring to FIG. 1, disclosed pallet systems can utilize two support runners that can form support stringers that interlock with one another to form a pallet matrix. As can be seen, support runner 10 includes two fork notches, 14A and 14B that, upon assembly with other support runners of a pallet, can provide a lifting tunnel for receiving the forks of a lift device. Support runner 10 also includes a series of support runner notches 20, 22, 24, 26, including outer support runner notches 20, 22 that are open at the lower edge 18 of support runner 10, and inner support runner notches 24, 26, that are open at the top edge 16, of support runner 12.

Also illustrated in FIG. 1 is support runner 12. Support runner 12, similar to support runner 10, defines two fork notches 14C and 14D. Support runner 12 also defines a series of support runner notches, 21, 23, 25, 27 including outer support runner notches 21 and 23 that are open at the upper edge 16 of support runner 12, and inner support runner notches 25, 27, that are open at the lower edge 18 of support runner 12.

In both support runner 10 and support runner 12, support runner notches 20, 21, 22, 23, 24, 25, 26, 27 can be used to interlock support runners to one another. As support runner notches are formed open to both the top edge 16 and the lower edge 18 of the support runners 10, 12, individual support runners will interlock from both above and below the pallet matrix, as discussed below and illustrated in further figures. This interweaving of support runners, such that assembly with one another includes the interlocking with other support runners from both above and below, provides additional strength to disclosed pallet systems as well as secure attachment of stringers to one another, such that no additional attachment materials, e.g., glue, staples, etc., are necessary.

Figure 2:
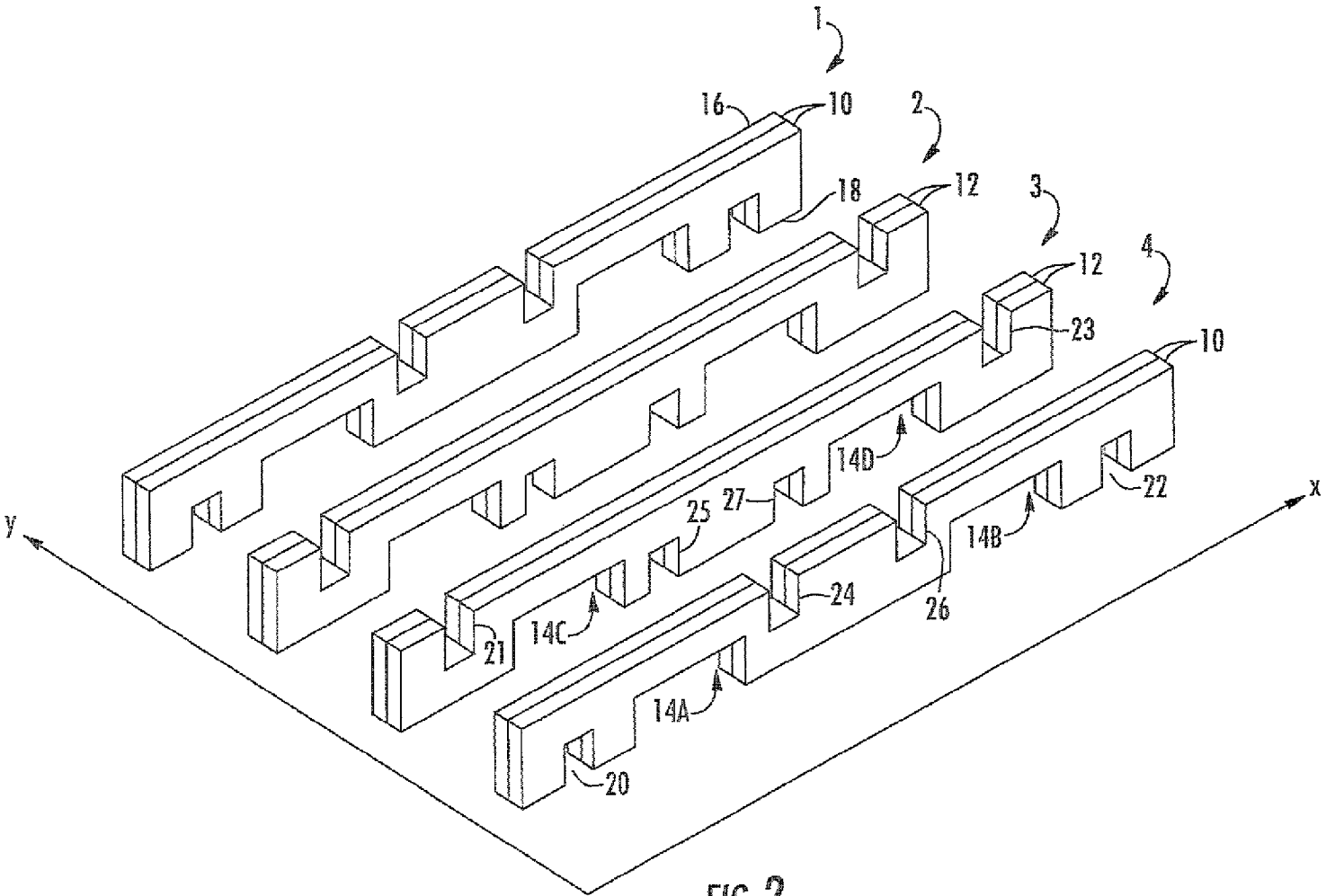
FIG. 2 illustrates an A-B-B-A stringer pattern as may be utilized in forming disclosed pallets.

To form a pallet matrix, a first set of support stringers arranged on a first axis can be interlocked with a second set of support stringers arranged on a second axis, generally perpendicular to the first axis. For example, FIG. 2 illustrates a first set of support stringers 1, 2, 3, 4, each of which is aligned parallel to an x-axis. As can be seen, each support stringer 1, 2, 3, 4 is formed of two identical support runners held adjacent to one another. For instance, support stringer 1 includes two support runners 10, 10, support stringer 2 includes two support runners 12, 12, and so on. Though illustrated in FIG. 2 as including two support runners, support stringers of disclosed pallet systems are not limited to two support runners and can conveniently be formed of any number of individual support runners including a single support runner, two, three, or more support runners, as desired. Preferred numbers of support runners for forming any one support stringer can depend, for example, upon the desired strength of a pallet, the existence of a deck cap on the pallet, and so forth.

Support stringers 1, 2, 3, 4 are arranged in an A-B-B-A pattern. Specifically, support stringer 1 is formed of two support runners 10, support stringer 2 is formed of two support runners 12, support stringer 3 is formed of two support runners 12, and support stringer 4 is formed of two support runners 10.

Figure 3:
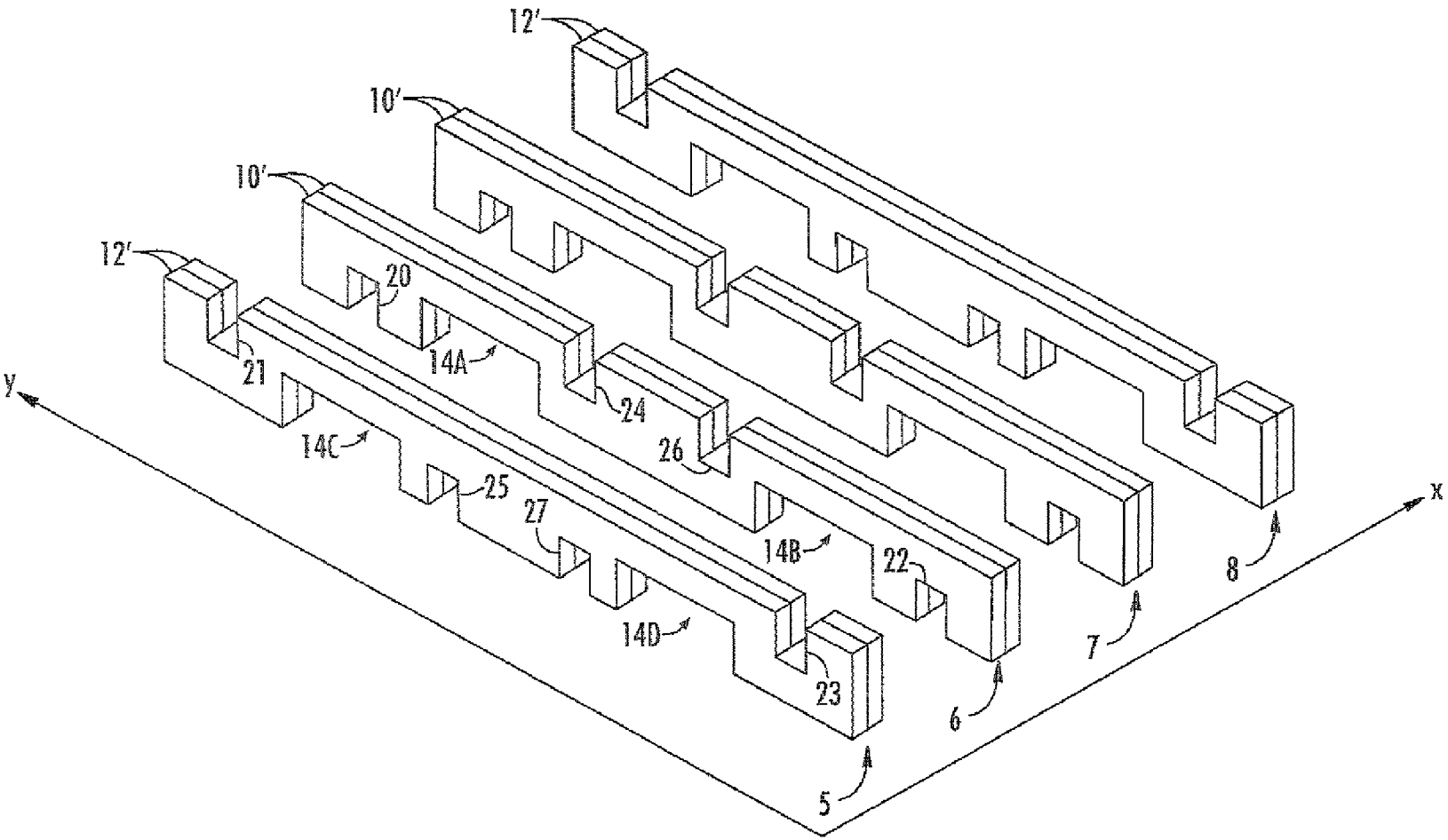
FIG. 3 illustrates a B-A-A-B stringer pattern that may be combined with the stringer pattern of FIG. 2 to form a pallet matrix as disclosed herein.

To form a pallet matrix, the first set of support stringers 1, 2, 3, 4 shown in FIG. 2 can be interlocked to a second set of support stringers 5, 6, 7, 8 illustrated in FIG. 3. As can be seen with reference to FIG. 3, this second set of support stringers 5, 6, 7, 8, is arranged such that each support stringer of the set is parallel to an axis y that is perpendicular to the x-axis of FIG. 2. In general, two sets of support stringers can be interlocked in perpendicular relationship to one another, as shown. This is not a requirement of disclosed pallet systems, however, and in other embodiments, sets of support stringers can be at an angle to one another other than perpendicular.

Support stringers 5, 6, 7, 8 are each formed of two individual support runners held immediately adjacent to one another as shown, and as is the case for support stringers 1, 2, 3, 4. In general, all support stringers of a pallet systems can include the same number of individual support runners for more simplified construction, but this is not a requirement of disclosed subject matter.

Support stringers 5, 6, 7, 8 are arranged in a similar but opposite pattern as support stringers 1, 2, 3, 4 with regard to the type of support runner used in forming the support stringers. More specifically, support stringers 1, 2, 3, 4 are arranged in an A-B-B-A pattern as described above, and support stringers 5, 6, 7, 8 are arranged in a B-A-A-B pattern, with support stringer 5 including two support runners 12', 12', support stringer 6 including two support runners 10', 10', support stringer 7, including two support runners 10', 10', and support stringer 8 including two support runners 12', 12', as shown.

Figure 4:
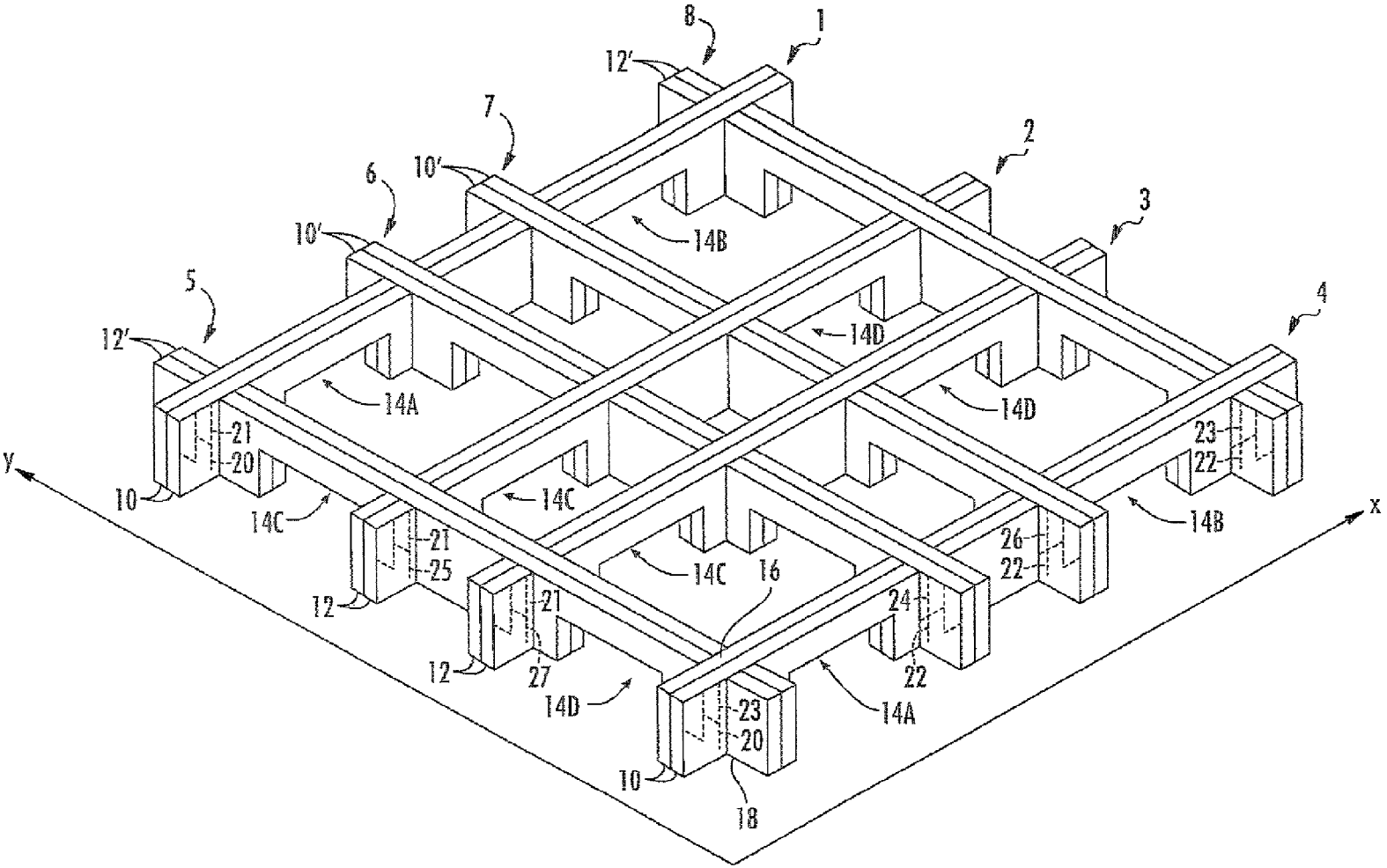
FIG. 4 illustrates a pallet matrix formed with the support runners held in the positions as illustrated in FIGS. 2 and 3.

FIG. 4 illustrates a pallet matrix following attachment of the support stringers of FIG. 2 with the support stringers of FIG. 3. Joints of the pallet matrix include a support runner notch open to the top of a support runner interlocked with a support runner notch open to the bottom of a support runner.

The formation of two joints as illustrated in FIG. 4 is described in detail. With reference to FIG. 1, support runner 10 includes support runner notch 20 that is open at the lower edge 18 of support runner 10. Support runner notch 20 can interlock with support runner notch 23 that is open on the upper edge 16 of a support runner 12 to form a corner joint of a pallet matrix, as shown in the lower corner joint of the embodiment of FIG. 4 in which two support runners form each support stringer. At this corner joint, the top edge 16 of the support runners 10 forming support stringer 4 will continue unbroken over the top of the joint, while the lower edge 18 of the support runners 12' forming support stringer 5 will continue unbroken over the bottom of the joint (not shown).

A second joint can include a support runner notch 24 that is open at the upper edge 16 of a support runner 10 interlocked with a support runner notch 22 that is open at the lower edge 18 of a second support runner 10', as shown. Following formation of this joint, the upper edge 16 of the support runners 10' forming support stringer 6 can continue unbroken over the joint and the lower edge 18 of support runners 10 forming support stringer 4 can continue unbroken over the bottom of the joint (not shown). Thus, the joints of a pallet matrix can include each support stringer interlocking with cross support stringers from both above and below along its length, so as to interweave the support stringers with one another.

Figure 5:
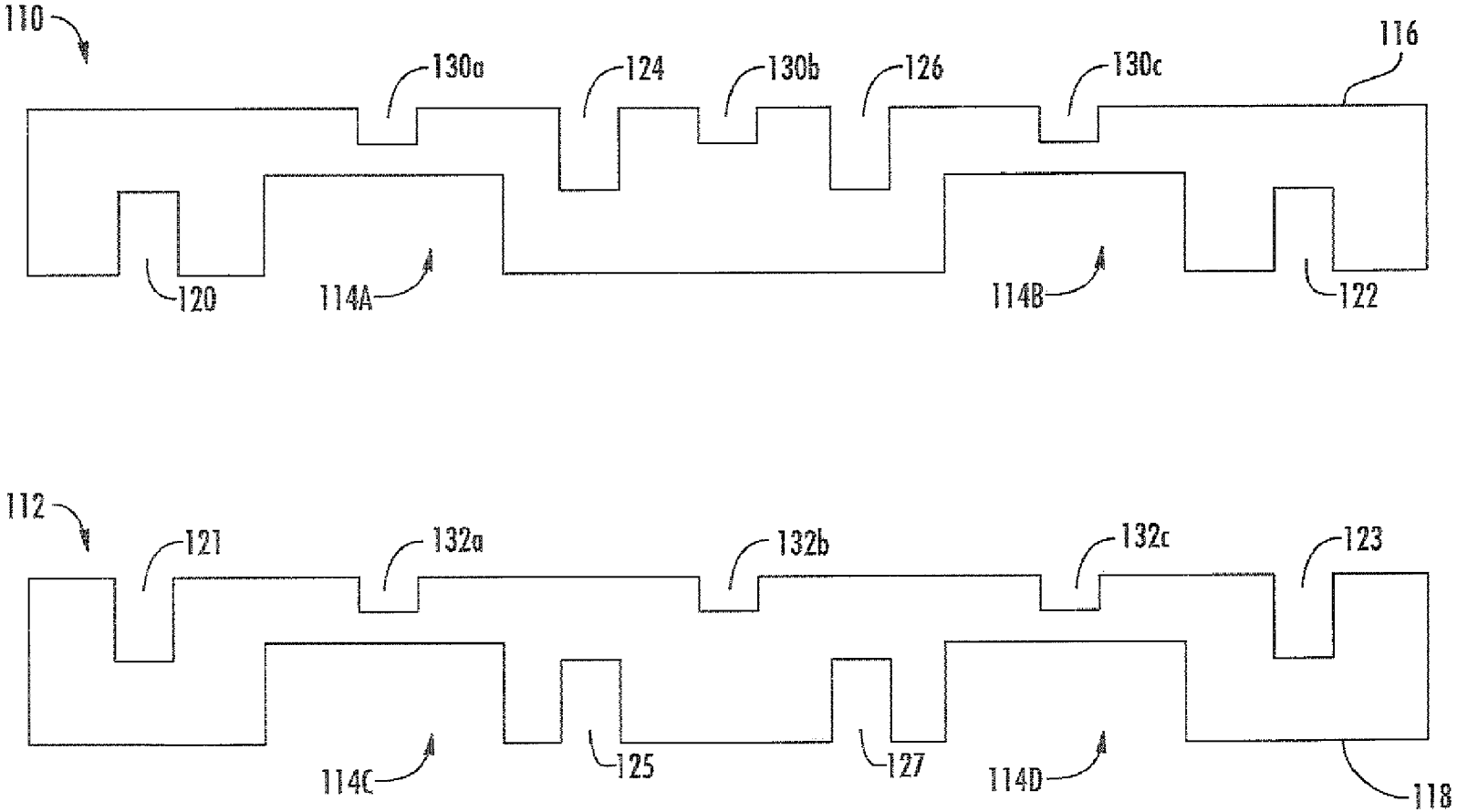
FIG. 5 illustrates another embodiment of support runners as may be utilized in forming disclosed pallets.

Interweaving of the support stringers can firmly attach the support stringers of the pallet to one another without the need for any additional attachment mechanism. Moreover, the A-B-B-A pattern of the support stringers can improve the strength of the pallet matrix. However, it should be understood that other support stringer patterns are encompassed by the present disclosure Disclosed pallet matrices can include pieces in addition to interlocked support stringers, for instance to further increase the strength of a system. For example, in one embodiment, disclosed systems can incorporate reinforcement runners. FIG. 5 illustrates two support runners 110, 112, that can be utilized in one such embodiment. Support runners 110, 112, include support runner notches 120, 121, 122, 123, 124, 125, 126, 127, as shown. In addition, support runners 110, 112 include reinforcement runner notches 130, 132. Specifically, support runner 110 includes three reinforcement runner notches 130*a*, 130*b*, 130*c* spaced across the support runner 110, all of which are open at upper edge 116 of support runner 110. Similarly, support runner 112, includes three reinforcement runner notches 132*a*, 132*b*, 132*c* spaced across the support runner 112, all of which are open at the upper edge 116 of support runner 112.

Figure 6:
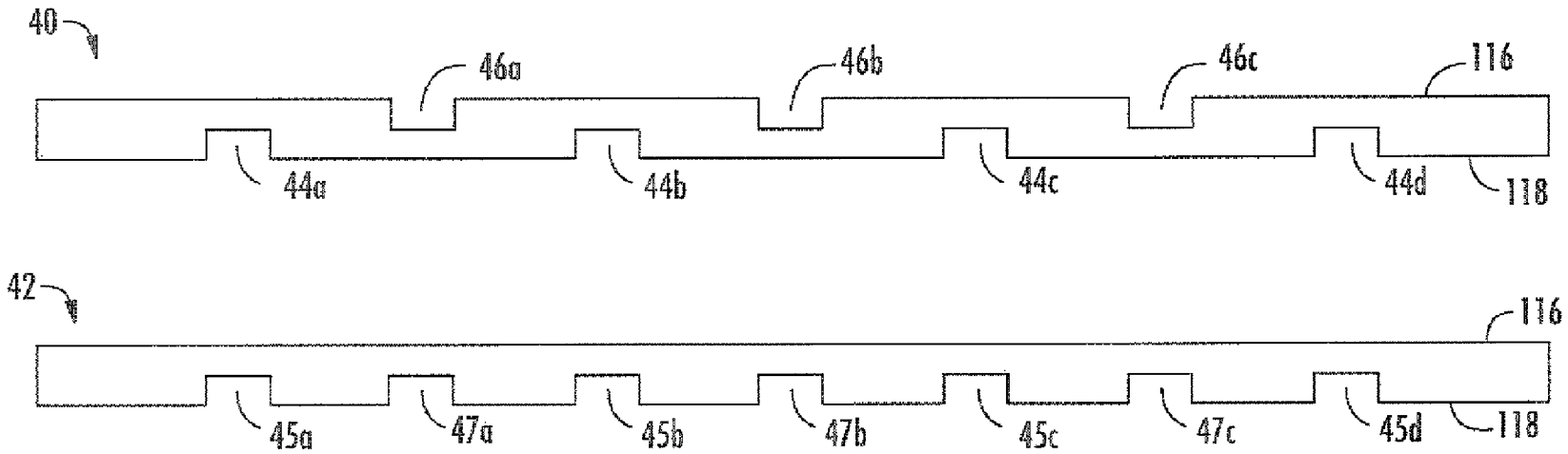
FIG. 6 illustrates one embodiment of reinforcement runners as may be utilized in forming disclosed pallets.

FIG. 6 illustrates reinforcement runners 40, 42 that can be incorporated into a pallet matrix in conjunction with support runners 110, 112. Reinforcement runner 40 includes three reinforcement runner notches 46*a*, 46*b*, 46*c*, formed so as to be open at the upper edge 116 of reinforcement runner 40. Reinforcement runner 40 also includes four support runner notches 44*a*, 44*b*, 44*c*, 44*d*, formed so as to be open at the lower edge 118 of reinforcement runner 40. Reinforcement runner 42 includes three reinforcement runner notches 47*a*, 47*b*, 47*c*, formed so as to be open at the lower edge 118 of reinforcement runner 42. Reinforcement runner 42 also includes four support runner notches 45*a*, 45*b*, 45*c*, 45*d*, formed so as to be open at the lower edge 118 of reinforcement runner 42.

Figure 7:
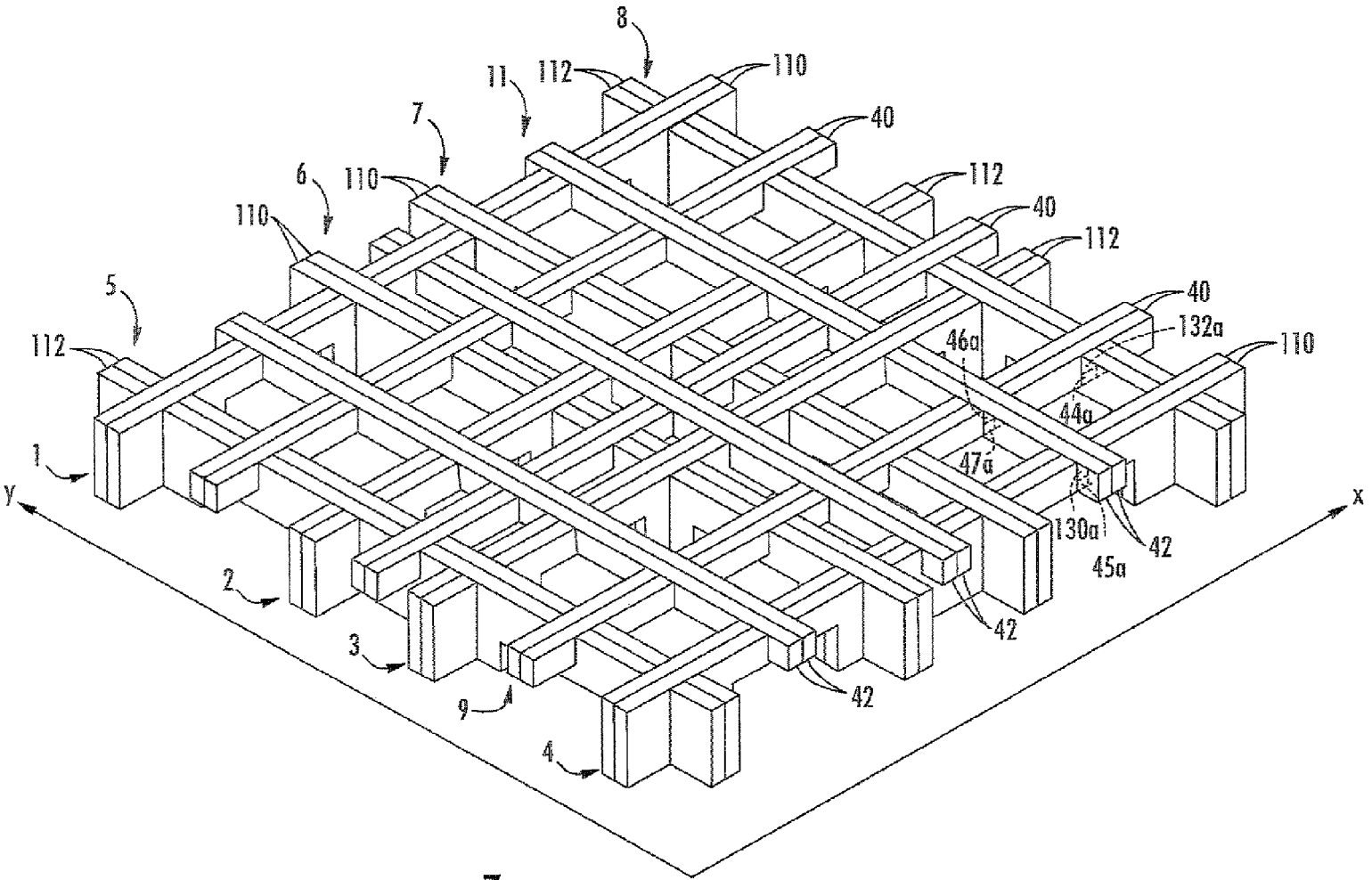
FIG. 7 illustrates a pallet matrix including both support stringers and reinforcement stringers in both the x- and y-directions of the pallet.

FIG. 7 illustrates a reinforced pallet matrix including support runners 110 and 112 of FIG. 5 and reinforcement runners 40 and 42 of FIG. 6. As can be seen, all stringers of the illustrated pallet matrix are formed of multiple individual runners, as discussed above. For instance, reinforcement stringer 9 is formed of two reinforcement runners 40, and reinforcement stringer 11 is formed of two reinforcement runners 42. Reinforcement stringers are not limited to any particular number of reinforcement runners, however.

Support stringers 1-8 are interlocked with one another as illustrated for the embodiment illustrated in FIG. 4. In addition, the matrix includes reinforcement runners 40 and 42. With regard to reinforcement runners 40 of reinforcement stringer 9, the support runner notches 44*a* of reinforcement runners 40 of reinforcement stringer 9 are interlocked with reinforcement notches 132*a* of support runners 112 of support stringer 8. Thus, the upper surface of reinforcement runners 40 of reinforcement stringer 9 extend unbroken at the joint formed between reinforcement stringer 9 and support stringer 8.

Similarly, with regard to reinforcement runners 42 of reinforcement stringer 11, the support runner notches 45*a* of reinforcement runners 42 of reinforcement stringer 11 are interlocked with reinforcement notches 130*a* of support runners 110 of support stringer 4. Thus, the upper surface of reinforcement runners 42 of reinforcement stringer 11 extends unbroken at the joint formed between reinforcement stringer 11 and support stringer 4.

Joints formed between a reinforcement runner 40 and a reinforcement runner 42 will involve the interlocking of a reinforcement runner notch 46 on reinforcement runner 40 and a reinforcement runner notch 47 on reinforcement runner 42. Accordingly, a joint formed between a reinforcement runner 40 and a reinforcement runner 42 will include the upper surface 116 of a reinforcement runner 42 extending unbroken over the joint and the lower surface 118 of a reinforcement runner 40 extending unbroken under the joint.

Of course, a pallet can include reinforcement stringers in both directions as the support stringers, as shown in FIG. 7 or can include reinforcement stringers in only a single direction.

Figure 8:
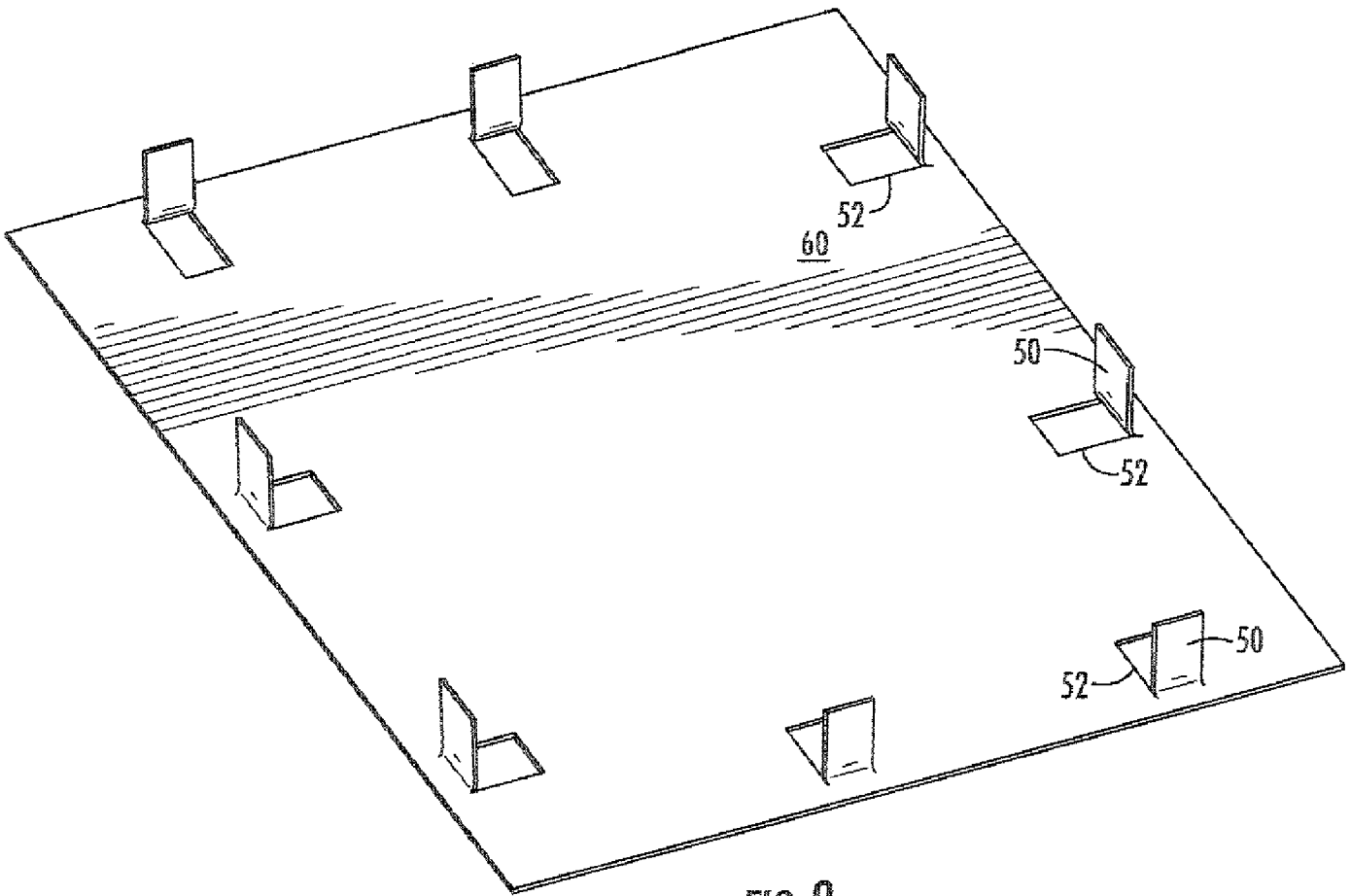
FIG. 8 illustrates a pallet cap as may be utilized in one embodiment.

In one embodiment, a pallet can include a deck cap, one embodiment of which is illustrated in FIG. 8. According to this embodiment, deck cap 60 can include a series of tabs 50 formed out of the material of deck cap 60 at cut outs 52.

Figure 9:
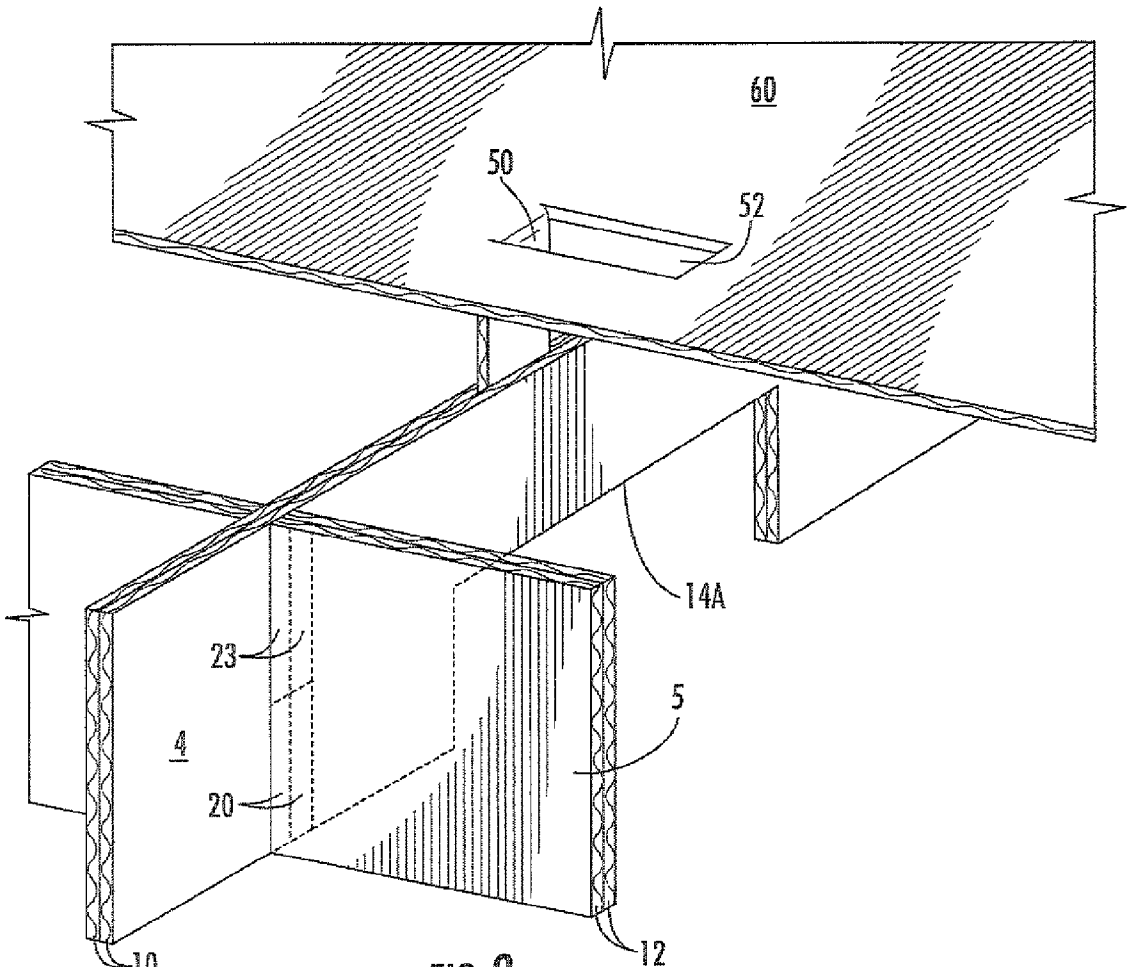
FIG. 9 illustrates one method of attaching a pallet cap to a pallet matrix.

Deck cap 60 can be attached to a pallet matrix without the need of any additional attachment materials. Referring to FIG. 9, deck cap 60 can be located over a pallet matrix, as shown. To attach deck cap 60 to the pallet matrix, a tab 50 can be located between support runners 10, 10 that together form a single support stringer 4. In the illustrated case, both tab 50 and support runners 10, 10 are formed of corrugated paperboard. In this particular embodiment, tab 50 can be simply forced between the two support runners 10, and will be held there with a friction hold. Tab 50 can be held between individual support runners of a support stringer by other means in those embodiments utilizing other materials. For instance, in other embodiments, individual support runners can include a notch that can hold a tab 50 by a friction fit, by the inclusion of a snap lock between the tab and a notch in the support runner, or according to any other means.

Figure 10:
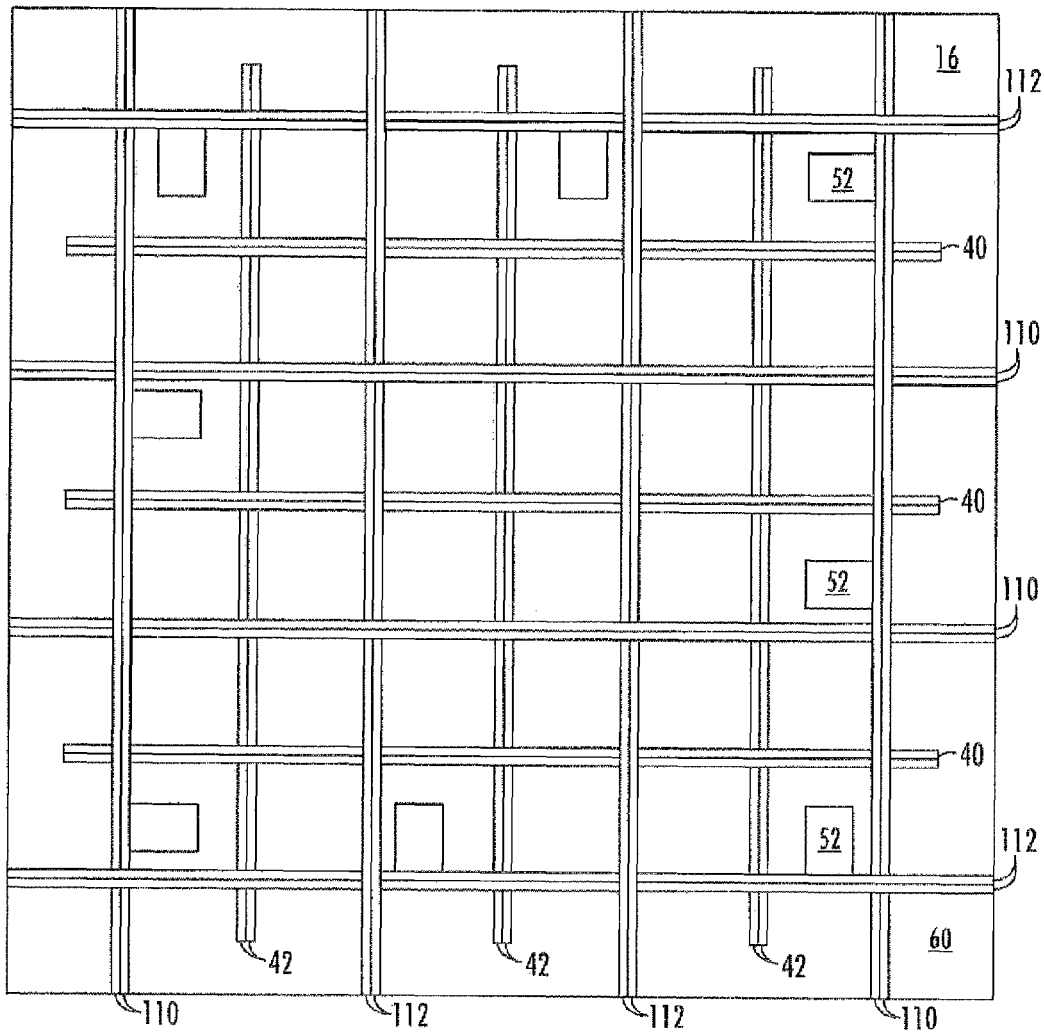
FIG. 10 illustrates one embodiment of a pallet system as disclosed herein.

FIG. 10 is a plan view of one embodiment of a pallet according to the disclosed subject matter. The illustrated pallet is viewed from below the pallet, i.e., looking at the lower edge 18 of the individual pieces of the pallet. As can be seen, the illustrated pallet includes a deck cap 60. Cut outs 52 define the tabs (not shown) that have been located between support runners 110, 112 to hold deck cap 60 to the top of the pallet matrix. The illustrated pallet includes the support runners 110, 112 interwoven with one another as described above, and also includes reinforcement runners 40, 42 running parallel to both the x- and y-axis of the pallet, as shown It will be appreciated that the foregoing examples, given for purposes of illustration, are not to be construed as limiting the scope of this disclosure. Although only a few exemplary embodiments have been described in detail above, those skilled in the art will readily appreciate that many modifications are possible in the exemplary embodiments without materially departing from the novel teachings and advantages of this disclosure. Accordingly, all such modifications are intended to be included within the scope of this disclosure as defined in the following claims and all equivalents thereto. Further, it is recognized that many embodiments may be conceived that do not achieve all of the advantages of some embodiments, yet the absence of a particular advantage shall not be construed to necessarily mean that such an embodiment is outside the scope of the presently disclosed subject matter.

What is claimed is:

1. A pallet system comprising eight support stringers in a four by four matrix, four of the eight stringers having an A pattern and four of the eight stringers having a B pattern, the four by four matrix including four support stringers aligned in an A-B-B-A pattern and four support stringers aligned in a B-A-A-B pattern, wherein each support stringer is interlocked with four other support stringers along the length of each support stringer, thereby defining four joints along the length of each support stringer, a first support stringer interlocking with a second support stringer from either an upper side or a lower side of the first support stringer, the first support stringer interlocking with a third support stringer from the other of the upper side or the lower side of the first support stringer, the upper side of the first support stringer and the lower side of the first support stringer being opposed to one another, the eight support stringers thereby being interwoven with one another, each support stringer including a first terminus and a second opposite terminus, the first and second opposite termini extending beyond all joints along the length of each support stringer; wherein the termini of each support stringer define the perimeter of said pallet system.

2. The pallet system of claim 1, wherein the first support stringer comprises multiple support runners.

3. The pallet system of claim 1, wherein the plurality of support stringers each comprise multiple support runners.

4. The pallet system of claim 1, wherein the eight support stringers are all formed of corrugated paperboard.

5. The pallet system of claim 1, wherein the pallet system is free of any attachment materials or devices.

6. The pallet system of claim 1, further comprising a reinforcement stringer.

7. The pallet system of claim 6, wherein the reinforcement stringer comprises more than one reinforcement runner.

8. The pallet system of claim 1, further comprising a deck cap.

9. The pallet system of claim 1, wherein the pallet system is formed exclusively of corrugated paperboard.

10. The pallet system of claim 1, wherein the pallet system can withstand greater than about 20,000 pounds of static compression at less than about ⅜ inch deflection.

11. The pallet system according to claim 1, wherein the A pattern includes a series of notches in an order along the length of the support stringer from the first terminus of the support stringer to the second terminus of the support stringer, the series and order of the notches including a first support runner notch open to the first side of the support stringer, a first fork notch open to the first side of the support stringer, a second support runner notch open to the second side of the support stringer, a third support runner notch open to the second side of the support stringer, a second fork notch open to the first side of the support stringer, and a fourth support runner notch open to the first side of the support stringer.

12. The pallet system according to claim 1, wherein the B pattern includes a series of notches in an order along the length of the support stringer from the first terminus of the support stringer to the second terminus of the support stringer, the series and order of the notches including a first support runner notch open to the second side of the support stringer, a first fork notch open to the first side of the support stringer, a second support runner notch open to the first side of the support stringer, a third support runner notch open to the first side of the support stringer, a second fork notch open to the first side of the support stringer, and a fourth support runner notch open to the second side of the support stringer.

13. A method of forming a pallet system comprising:

interlocking a first support stringer with a second support stringer from either an upper side or a lower side of the first support stringer to form a first joint;

interlocking the first support stringer with a third support stringer from the other of the upper side or the lower side of the first support stringer to form a second joint, the upper side of the first support stringer and the lower side of the first support stringer being opposed to one another;

interlocking additional support stringers with one another and with the first, second, and third support stringers to form a four by four matrix of interwoven support stringers that are interlocked at a series of joints said joints provided along the longitudinal length of each support stringer, each support stringer defining either an A pattern or a B pattern, the four by four matrix including four of the support stringers aligned in an A-B-B-A pattern and four of the support stringers aligned in a B-A-A-B pattern, each support stringer including a first terminus and a second terminus, wherein the first and second termini of each support stringer extend beyond all joints of that stringer; wherein the termini of each support stringer define the perimeter of said pallet system.

14. The method according to claim 13, wherein the support stringers are interlocked with one another with no attachment devices or materials incorporated with the support stringers.

15. The method according to claim 13, further comprising interlocking a reinforcement stringer with the first stringer.

16. The method according to claim 13, further comprising attaching a deck cap to the pallet system.

17. The method according to claim 16, wherein the deck cap is attached to the pallet system with no attachment device or material incorporated with the deck cap.

18. The method according to claim 13, wherein the first, second, and third support stringers are formed of corrugated paperboard.

19. The method according to claim 13, further comprising aligning multiple support runners with one another to form the first support stringer.

20. The method according to claim 13, comprising forming the pallet system exclusively of corrugated paperboard.

* * * * *